US011844448B2

(12) United States Patent
Spiro et al.

(10) Patent No.: US 11,844,448 B2
(45) Date of Patent: Dec. 19, 2023

(54) VERTICAL SLOT HANGER

(71) Applicant: Tracer Imaging LLC, Ossining, NY (US)

(72) Inventors: Steven M. Spiro, Chappaqua, NY (US); Jessica Huffman, Wilton, CT (US); Ryan Kelly, Scarsdale, NY (US)

(73) Assignee: Tracer Imaging LLC, Ossining, NY (US)

( * ) Notice: Subject to any disclaimer, the term of this patent is extended or adjusted under 35 U.S.C. 154(b) by 0 days.

(21) Appl. No.: 17/587,128

(22) Filed: Jan. 28, 2022

(65) Prior Publication Data

US 2022/0265069 A1 Aug. 25, 2022

Related U.S. Application Data

(60) Provisional application No. 63/157,284, filed on Mar. 5, 2021, provisional application No. 63/153,605, filed on Feb. 25, 2021.

(51) Int. Cl.
*A47G 1/16* (2006.01)

(52) U.S. Cl.
CPC ..... *A47G 1/1686* (2013.01); *A47G 1/1666* (2013.01)

(58) Field of Classification Search
CPC ..... A47G 1/1686; A47G 1/1666; A47G 2001/0661; A47G 1/0638; G09F 15/0018
USPC ..... 40/757, 758, 759, 792, 604, 659 M, 603, 40/666; 411/107, 510, 508, 509
See application file for complete search history.

(56) References Cited

U.S. PATENT DOCUMENTS 762,659 A * 6/1904 Schaffer ..... A47H 13/00 160/391
1,738,273 A * 12/1929 Anderson ..... B60R 13/105 40/209
1,809,786 A * 6/1931 Le Jeune ..... A47G 1/06 40/757

(Continued)

FOREIGN PATENT DOCUMENTS

DE 3811999 A * 10/1988 ..... F16B 19/00
KR 200388730 Y1 * 7/2005

(Continued)

*Primary Examiner* — Kimberly T Wood
(74) *Attorney, Agent, or Firm* — Leason Ellis LLP

(57) ABSTRACT

A vertical slot hanger assembly includes a substrate having a top edge and a bottom edge and a plurality of holes or slits formed therein along each of the top edge and the bottom edge. The assembly further includes a top rail and a bottom rail. Each of the top rail and the bottom rail includes a recessed channel that extends in a longitudinal direction. Each rail has a plurality of blind holes formed therein. Each blind hole intersects the recessed channel. The top edge of the substrate is received within the recessed channel of the top rail and the bottom edge of the substrate is received within the recessed channel of the bottom rail. The system further includes an elongated hanging element that is disposed within the recessed channel between the top edge of the substrate and a top surface of the recessed channel. The system includes a plurality of fasteners for reception in the plurality of blind holes. Each fastener passes through one hole or slit of the substrate and is frictionally held and anchored within the respective blind hole, thereby securely coupling the substrate to the top rail and the bottom rail.

15 Claims, 5 Drawing Sheets

(56) References Cited

U.S. PATENT DOCUMENTS 2,056,565 A * 10/1936 Coray ..... G09F 15/0018 40/757
3,009,381 A * 11/1961 Rapata ..... G09F 7/18 40/668
3,298,374 A * 1/1967 Grundell ..... B42F 21/065 402/75
3,312,008 A * 4/1967 Yarder ..... A47G 1/10 40/759
3,494,244 A * 2/1970 Wayland ..... F16B 21/084 24/453
3,665,628 A * 5/1972 Dammond ..... A47G 1/0638 40/792
4,138,921 A * 2/1979 McGauran ..... F16B 5/0642 411/476
4,161,834 A * 7/1979 Hendricks, Jr. ..... G09F 15/0006 40/607.13
4,204,350 A * 5/1980 Brenner ..... A47G 1/0605 428/904.4
4,356,647 A * 11/1982 Farris ..... G09F 15/02 D6/300
4,459,773 A * 7/1984 Sandlin ..... G09F 15/02 40/739
4,862,610 A * 9/1989 Lawless ..... B44D 3/185 403/387
4,869,440 A * 9/1989 Toral ..... G11B 23/08785 411/455
4,900,210 A * 2/1990 Buchanan ..... F16B 33/006 411/510
5,090,145 A * 2/1992 Chiang ..... A47G 1/065 40/605
6,192,611 B1 * 2/2001 Molla ..... G09F 17/00 40/604
6,474,009 B2 * 11/2002 Hahn ..... G09F 3/20 40/658
D487,354 S * 3/2004 Hahn ..... D6/300
7,086,190 B2 * 8/2006 Voluckas ..... G09F 17/00 40/604
7,296,373 B1 * 11/2007 Hahn ..... G09F 15/0012 40/658
9,370,247 B1 * 6/2016 Caldwell ..... A47C 7/16
10,244,875 B1 * 4/2019 Lydon ..... G09F 17/00
10,803,777 B1 * 10/2020 Moody ..... A47G 1/0638
11,313,120 B2 * 4/2022 Bibi ..... E04B 2/80
2004/0163295 A1 * 8/2004 Fontana ..... A47F 7/163 40/611.02
2004/0250458 A1 * 12/2004 Kim ..... G09F 17/00 40/617
2008/0000056 A1 * 1/2008 Murray ..... E04H 15/646 24/460
2009/0205166 A1 * 8/2009 Murray ..... E04H 15/646 16/221
2016/0360903 A1 * 12/2016 Knowlden ..... G09F 15/0012
2020/0138208 A1 * 5/2020 Morriss ..... A47G 1/18
2022/0211195 A1 * 7/2022 Morriss ..... A47G 1/162
2022/0233000 A1 * 7/2022 Spiro ..... B44D 3/18

FOREIGN PATENT DOCUMENTS

WO WO-0000948 A1 * 1/2000 ..... F16B 5/02
WO WO-2015117161 A2 * 8/2015 ..... F16B 17/004

* cited by examiner

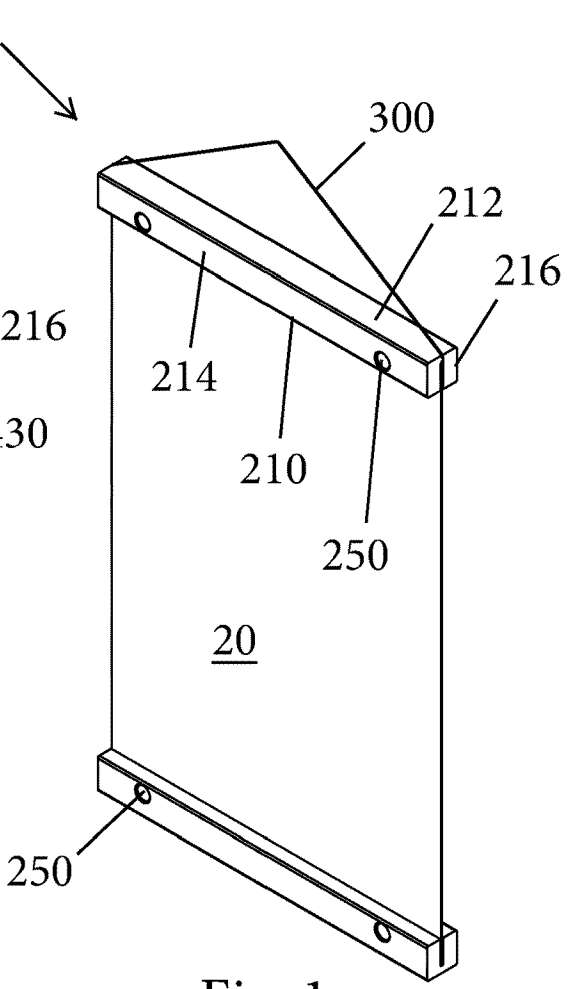
Fig. 1
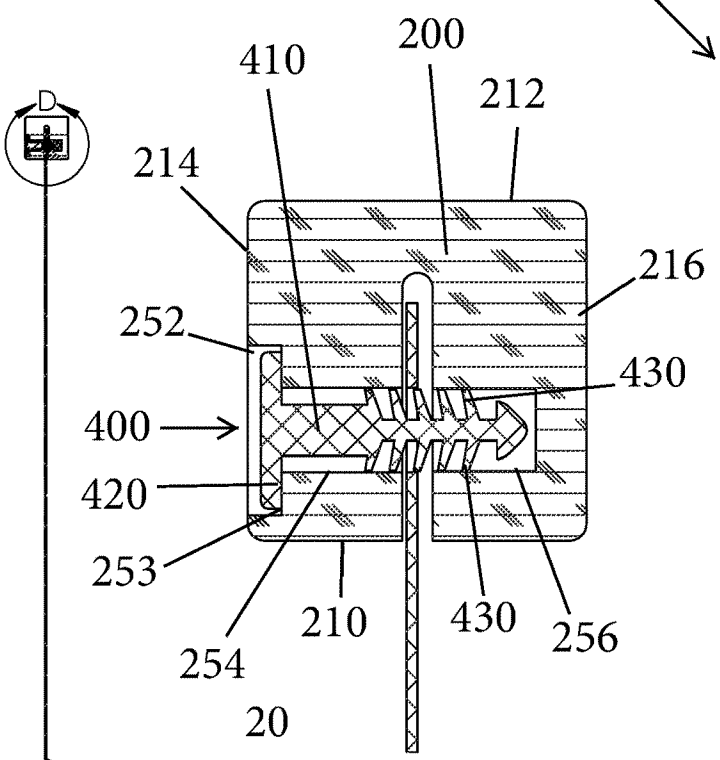
Fig. 4
Fig. 3
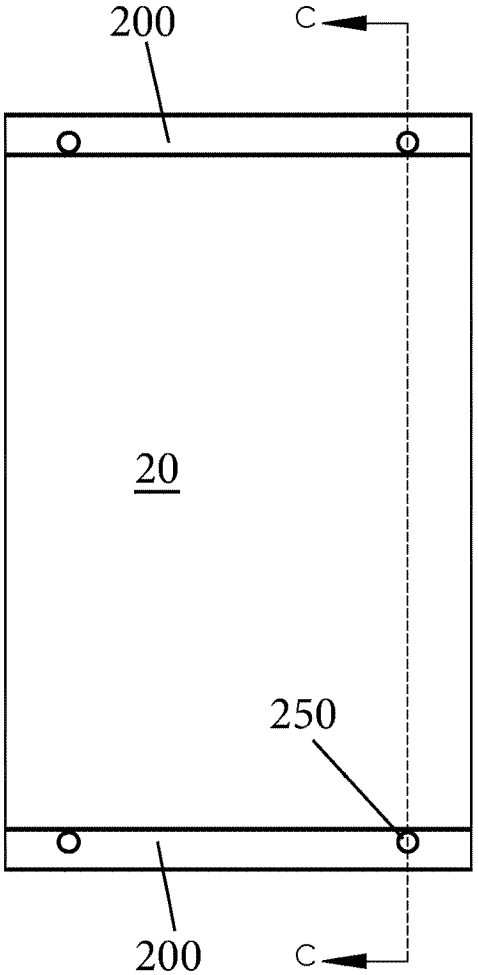
Fig. 2

VERTICAL SLOT HANGER

CROSS REFERENCE TO RELATED APPLICATION

The present application claims priority to and the benefit of U.S. patent application Ser. No. 63/153,605, filed Feb. 25, 2021 and U.S. patent application Ser. No. 63/157,284, filed Mar. 5, 2021, each of which is hereby incorporated by reference in its entirety.

TECHNICAL FIELD

The present disclosure is directed to an article for displaying a substrate, such as a canvas, photograph or artwork, and more particularly, relates to a vertical slot hanger that is configured to capture and hold the substrate and also be hung on a support surface, such as a wall.

BACKGROUND

For years, the most common way for displaying an object, such as a canvas, on a support surface, such as a wall, is to use a frame that holds the object and is configured to be hung on the wall. There are many different types of frames with the most common ones being those that completely surround the object. For some objects, like tapestries, flags, banners, and scrolls, etc., they can be hung by a top rod that passes though a pocket or closed channel formed at the top of the object to be hung.

There is a desire to provide an alternative way to hang an object that is easier to assembly and also does not require the object, such as a canvas, to have a special construction, such as the top pocket or closed channel mentioned above.

SUMMARY

In one embodiment of the present disclosure, a vertical slot hanger assembly includes a substrate having a top edge and a bottom edge and a plurality of holes or slits formed therein along each of the top edge and the bottom edge. The assembly further includes a top rail and a bottom rail. Each of the top rail and the bottom rail includes a recessed channel that extends in a longitudinal direction. Each rail has a plurality of blind holes formed therein. Each blind hole intersects the recessed channel. The top edge of the substrate is received within the recessed channel of the top rail and the bottom edge of the substrate is received within the recessed channel of the bottom rail. The system further includes an elongated hanging element that is disposed within the recessed channel between the top edge of the substrate and a top surface of the recessed channel. The system includes a plurality of fasteners for reception in the plurality of blind holes. Each fastener passes through one hole or slit of the substrate and is frictionally held and anchored within the respective blind hole, thereby securely coupling the substrate to the top rail and the bottom rail.

BRIEF DESCRIPTION OF THE DRAWING FIGURES

FIG. 1 is a vertical slot hanger assembly according to one embodiment;

FIG. 2 is front elevation view thereof without an elongated hanging element;

FIG. 3 is a cross-sectional view taken along the line C-C of FIG. 2;

FIG. 4 is an enlarged detail of a rail and fastener combination;

DETAILED DESCRIPTION OF CERTAIN EMBODIMENTS

Figure 6:
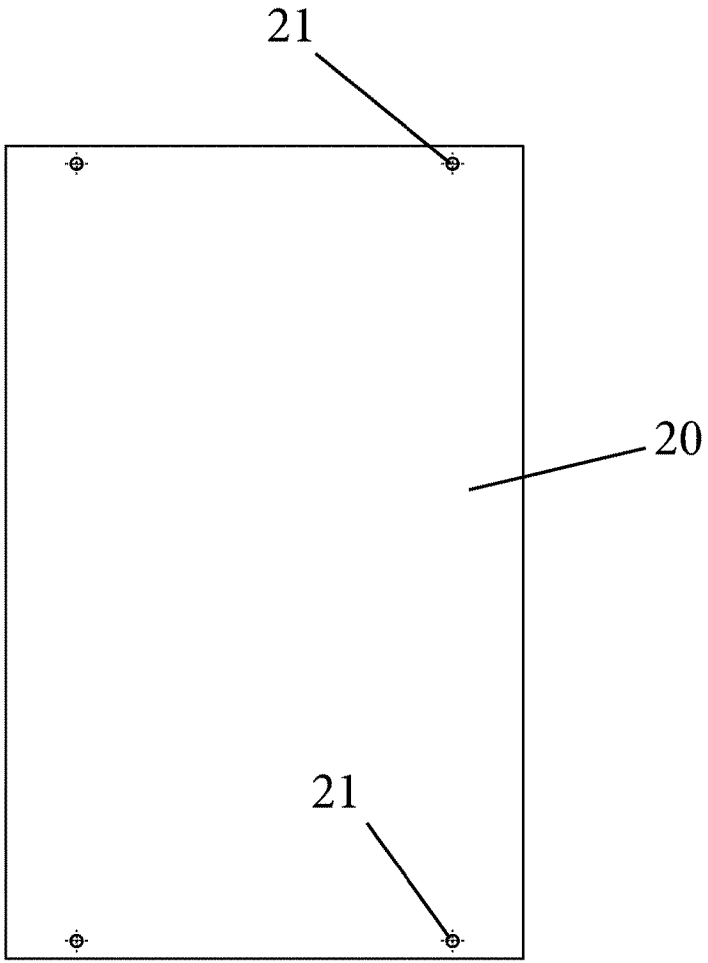
FIG. 6 is a front elevation view of the substrate separate from a backing/border element.

In accordance with the present disclosure, as illustrated in FIG. 1, a display system or assembly (kit) is shown and described and is configured to create an article that can be displayed and hung on a support surface, such as a wall.

Substrate 20

The article is configured to display an object that is in in the form of a substrate 20 that is held and displayed within the article. The substrate 20 can take many different forms, such as a piece of a paper stock, a photo, artwork, a canvas, or other artistic expression that is embodied in the substrate 20. In one preferred embodiment, the substrate 20 is in the form of a canvas (rollable piece of canvas).

As described herein, the article provides an easy to use and easy to assemble kit that allows a user to assemble and hold the substrate 20 therein.

In the present disclosure, the article takes the form of a vertical slot hanger assembly 100. Besides the substrate 20 that is to be hung, the vertical slot hanger assembly 100 has the following main parts, namely, a pair of rails 200 and an elongated hanging element 300, such as a cable, string, yarn, wire, etc. For ease of discussion, the elongated hanging element 300 is described herein as being string 300; however, as mentioned, this element is not limited to only being a string.

As shown in FIG. 6, the substrate 20 includes a pair of holes or slits 21 formed along at least one edge and preferably, along the top and bottom edges of the substrate 20. The holes 21 can have any number of different shapes, including circular shaped holes. There can be two holes 21 spaced apart and formed along the top edge of the substrate 20 and two holes 21 spaced apart and formed along the bottom edge of the substrate 20.

Figure 5:
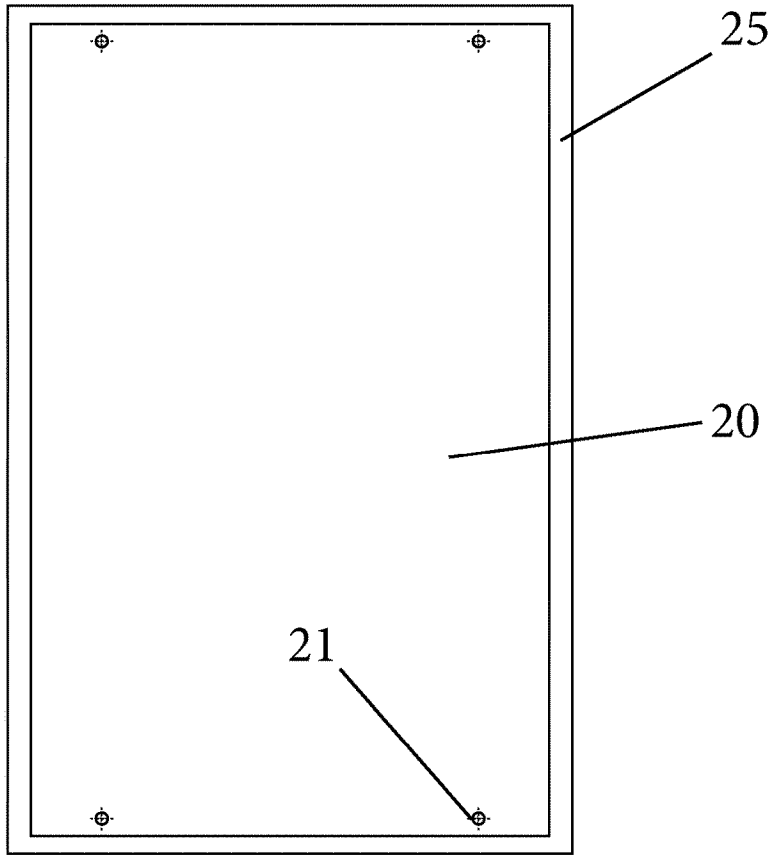
FIG. 5 is a front elevation view of a substrate template.

Substrate Template (FIG. 5)

In one embodiment, the substrate 20 is part of a template that includes release liner 25.

The substrate 20 (e.g., canvas layer) is attached to the release liner 25 via an adhesive layer. All three layers (canvas 20, adhesive, liner 25) are all cut to the same size. The stack is then kiss-cut on a smaller rectangular profile such that the canvas is cut through but the liner remains intact. After the kiss cut process, the assembly is run through a printer so that an image can be printed on the canvas. The image can be printed such that it extends past the border of the kiss-cut. The kiss-cut inner rectangle of canvas is then peeled off of the liner, leaving the adhesive on the liner. This yields a rectangle of canvas with a full-bleed image printed on it that is free of any adhesive. The liner, adhesive, and remaining border of canvas are considered waste materials.

Pair of Rails 200

The vertical slot hanger assembly 100 includes the pair of rails 200. Each rail 200 has an elongated body with an inner surface 210, an opposing outer surface 212, a front surface 214 and a rear surface 216. Along the inner surface 210 there is a recessed channel (groove) 220. The recessed channel 220 extends longitudinally along the length of the rail 200. In the illustrated embodiment, the channel 220 extends the entire length of the rail 220; however, in other embodiments, it does not extend the entire length. While the illustrated embodiment depicts a single continuous channel 220 that runs along the inner surface 210, it will be appreciated that the channel 220 can segmented and formed of a plurality of spaced channels that are co-linear (co-axial).

The channel 220 can be considered to be a vertical slot. In addition, while the front surface 214 and the rear surface 216 are shown as being parallel to one another, they can be oriented in a non-parallel manner.

The channel 220 is shown as being centrally formed along the inner surface 210 which is the preferred location. However, it is possible to form the channel 220 at an off-center position.

The rail 200 can thus be considered to be a female component due to the presence of the center recessed channel 220.

In addition, while the channel 220 is shown as extending along the entire length of the rail 200, it will be appreciated that the rail 200 can have solid ends with the channel 220 formed between these two solid ends. The width of the channel 220 is selected in view of the width of the substrate 20 in that the substrate 20 should be easily inserted into the channel 220 but there is little empty space between the substrate 20 and the front and back faces of the channel 220.

The rail 200 can be formed of any number of different materials, including but not limited to, wood, plastic, metal, etc.

Typically, the two rails 200 have identical constructions (e.g., identical lengths); however, it is possibly for one rail 200 to be longer than the other one as in the case of when the substrate 20 has one end that is wider (longer) than the other end.

Each rail 200 has a plurality of holes 250 that are formed in the rail 200 in spaced relationship from one another. As shown in the cross-sectional view of FIG. 4, the hole 250 is not a through hole but instead is a blind hole that has a closed end. The hole 250 can be thought of as having multiple different sections in that the hole 250 has a recessed section (counterbore section) 252, a first shaft section 254 and a second shaft section 256 that terminates in the closed end of the hole 250. The recessed section 252 is counter sunk and includes a landing 253 surrounding the hole. The second shaft section 256 has a slightly smaller diameter than the first shaft section 254.

It will be appreciated that, as shown, the holes 250 pass through the channel 220.

Elongated Hanging Element 300

As mentioned herein, the elongated hanging element 300 can be in the form of a string, cable, rope, cord or the like that is used to hang the entire vertical slot hanger assembly 100 including the substrate 20.

Fasteners 400

The vertical slot hanger assembly 100 also includes a plurality of fasteners 400 for securely attaching the substrate 20 to the respective rails 200. Each fastener 400 is designed to be received within one respective hole 250 for attaching the substrate 20 to the rail 200. The fastener 400 has an elongated shaft 410 with an enlarged head 420 formed at one end thereof. Along the shaft 410 there are plurality of barbs 430 that extend outwardly from the shaft 410. In one embodiment, the fastener 400 can have a construction that is similar to a plastic anchor.

The head 420 is designed to be received within the recessed section 252 and seat against the landing 253 when the fastener 400 is fully seated within the hole 250. The second shaft section 256 is designed so that its diameter is slightly less than the diameter of the barbed section of the fastener 400 and this causes the barbs 430 to snugly fit within the second shaft section 256 of the hole. This snug is the means by which the fastener 400 seats and is held within the hole 250.

As mentioned, the fasteners 400 are designed to be received through the holes or slits 21 of the substrate 20 as a way to attach the substrate to the rail 200.

The fastener 400 can be formed of any number of suitable materials, including but not limited to plastic, wood and metal.

Assembly Process

To assemble the vertical slot hanger assembly 100, the user prepares the substrate 20 as described herein. The illustrated substrate 20 has two holes 21 along the top edge and two holes 21 along the bottom edge.

The elongated hanging element 300 is fed through the channel 220 and is placed along the closed end of the channel 220. In other words, the elongated hanging element 300 is disposed in the recessed channel and can be fully contained therein. The elongated hanging element 300 can be a loop with one portion contained in the recessed channel 220 and the other being disposed outside the rail. The size of the elongated hanging element 300 (e.g., looped string) is such that it does not prevent or interfere with the reception of the edge of the substrate within the channel.

Next, the top edge of the substrate 20 is fed into the channel 220 that is formed in the rail 200 that will become the top rail. The holes 21 of the substrate 20 are then aligned with the holes 250 formed in the rail 200. In this position, the elongated hanging element 300 is located between the top edge of the substrate 20 and the closed end of the channel 220. To secure and hold the substrate 20 in place within the channel 220, the fasteners 400 are fed into the holes 250 and pass through the holes/slits 21 formed in the substrate 20. The fasteners 400 are pushed into the holes 250 until the barbs 430 enter into the second shaft section 256 and fit snug therein. This snug fit effectively anchors the substrate 20 within the channel 220, thereby attaching the substrate 20 to the top rail 200. The process is repeated for each hole 250 formed in the top rail 200.

To complete the bottom of the assembly, the bottom edge of the substrate 20 is fed into the channel 220 that is formed in the rail 200 that will become the bottom rail. The holes 21 of the substrate 20 are then aligned with the holes 250 formed in the bottom rail 200. To secure and hold the bottom edge of the substrate 20 in place within the channel 220, the fasteners 400 are fed into the holes 250 and pass through the holes/slits 21 formed in and along the bottom edge of the substrate 20. The fasteners 400 are pushed into the holes 250 until the barbs 430 enter into the second shaft section 256 and fit snug therein. This snug fit effectively anchors the substrate 20 within the channel 220, thereby attaching the substrate 20 to the bottom rail 200.

It will also be appreciated that in one embodiment, the bottom rail can be eliminated. In this embodiment, the bottom end of the substrate 20 is left without the rail and has a "rough" appearance. However, the inclusion of the bottom rail gives the bottom end of the substrate 20 some weight allowing the substrate 20 to hang vertically without rolling up at the bottom.

In addition, the string 300 can also be coupled to the frame using other techniques instead of passages through the channel 220. For example, the elongated hanging element (string) 300 can be directly attached to the outer surface 212.

To hang the vertical slot hanger assembly 100 to a support surface, such as a wall, the string 300 is hung on a fastener, such as a nail, screw or picture mounting hardware that is attached to the support surface.

The vertical slot hanger assembly 100 thus provides an easy, fast, and effective manner for hanging the vertical slot hanger assembly to the support structure.

Alternative Embodiment

Figure 7:
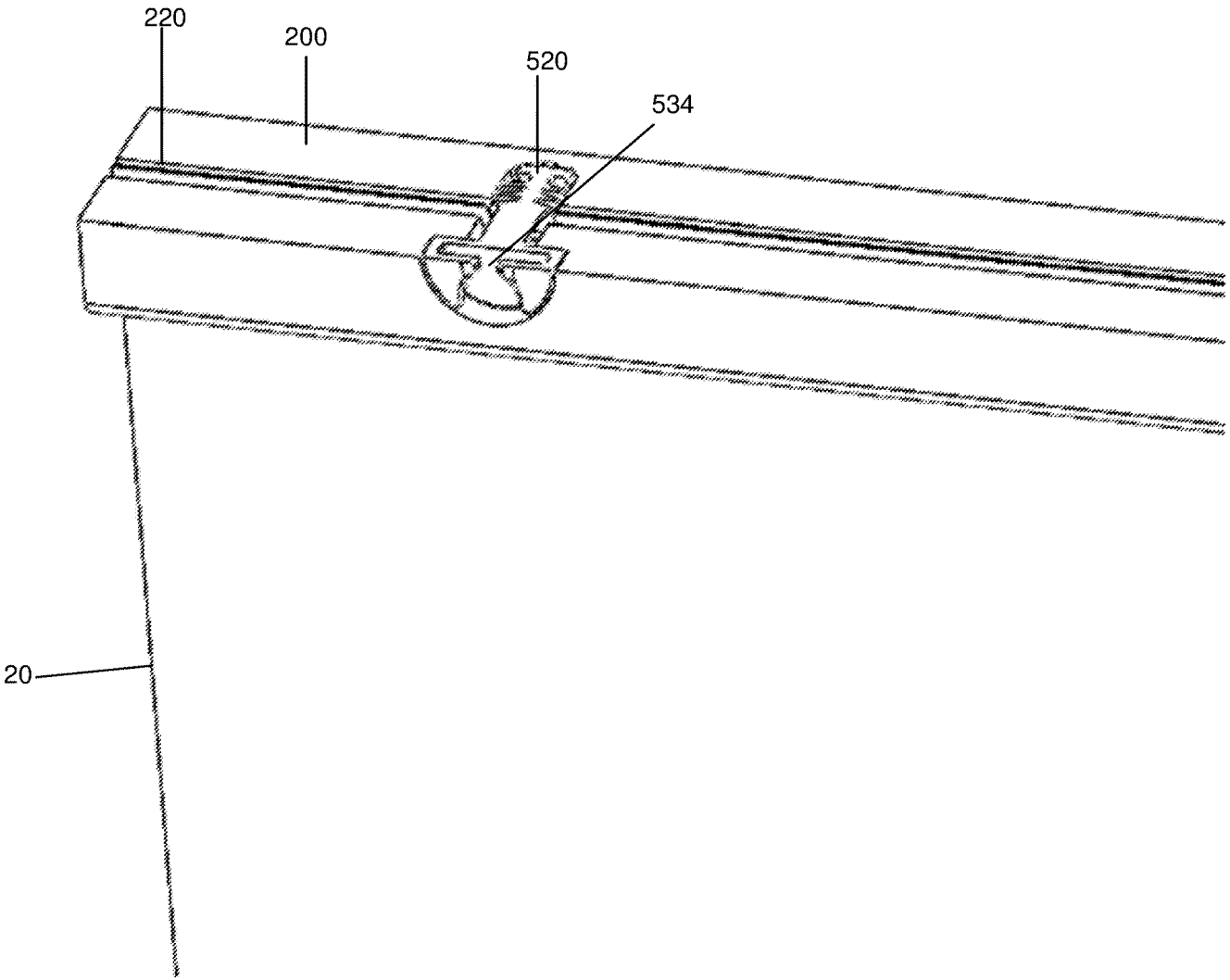
FIG. 7 is a cross-sectional perspective view showing use of a fastener for attaching the substrate to the assembly.
Figure 8:
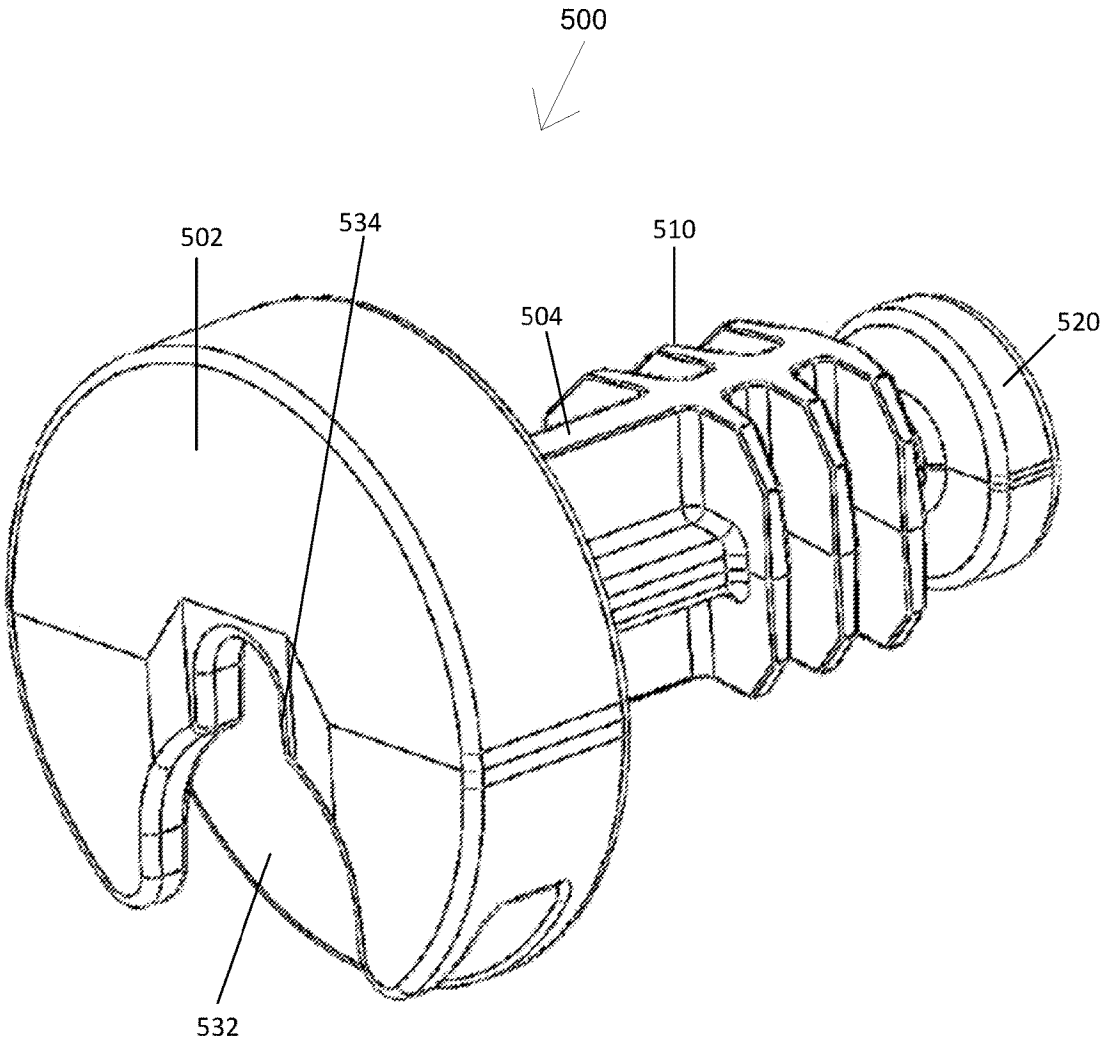
FIG. 8 is a side perspective view of the fastener.
Figure 9:
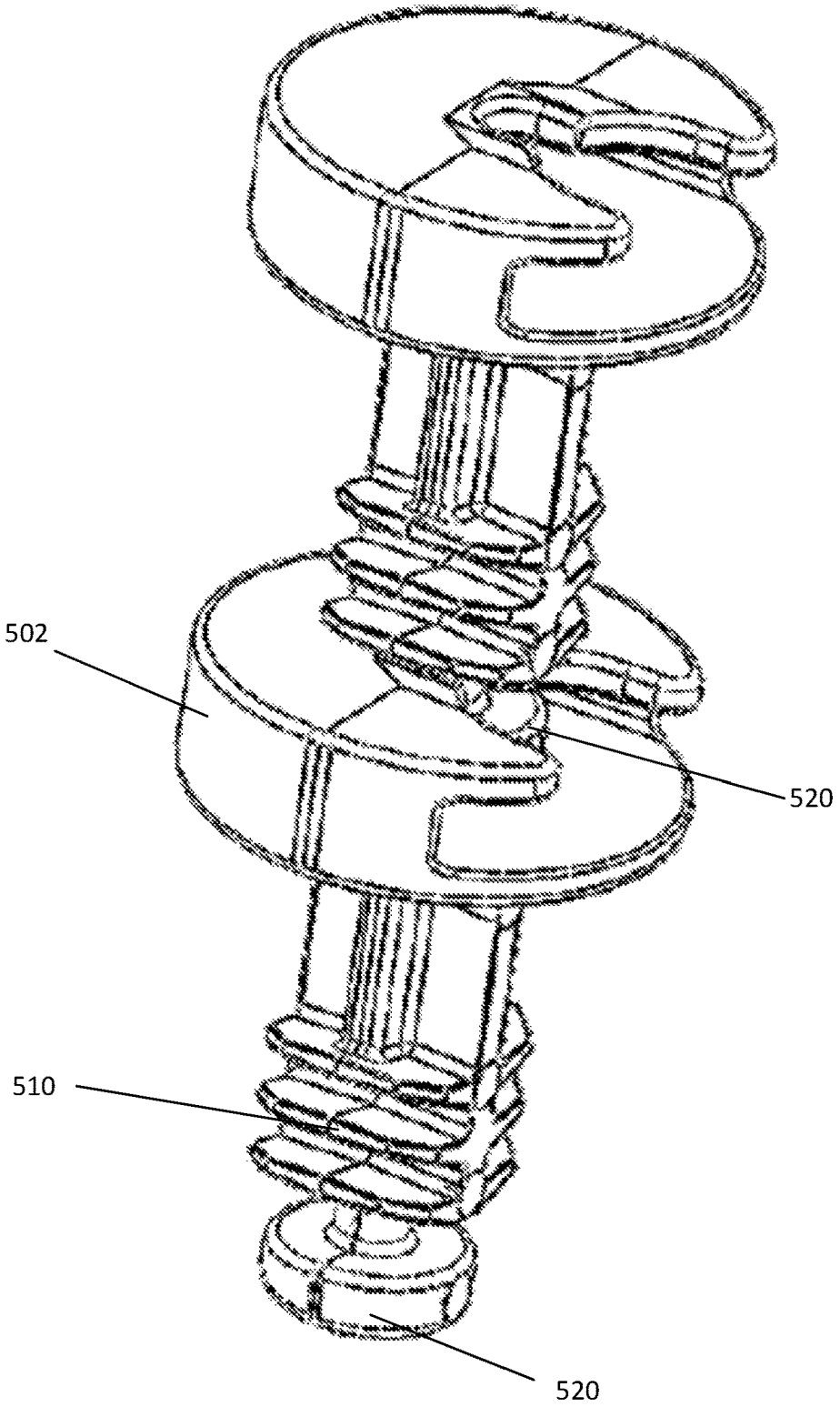
FIG. 9 is a side perspective view of two fasteners coupled to one another.

FIGS. 7-9 illustrate another embodiment and more specifically, illustrate the use of different fasteners 500 for attaching the substrate 20 (e.g., canvas) the rail 200. Like elements are numbered alike in the drawings. The rail 200 has the same construction as described above.

The fasteners 500 are similar to fasteners 400 in that each fastener 500 includes an enlarged head 502 and an elongated shaft 504 and each is configured to attach and hold the substrate 20 in place within the rail. Along the shaft 504 there are barbs 510 that protrude outwardly. The two main differences between fastener 500 and fastener 400 lies in the head design and at the design of the distal end opposite the head.

At the distal end of the fastener 500, there is a coupling member 520 at an end of the shaft 504. As described herein, the coupling member 520 is configured to mate with another fastener 500 as a means for removing the other fastener 500 from the assembly. In the illustrated embodiment, the coupling member 520 is in the form of a ball or disk-shaped member (as shown). Immediately above the coupling member 520 is a neck or waist that is connected to the main shaft of the fastener. The neck/waist has a diameter less than the diameter of the coupling member 520.

The head 502 includes a cutout (open space) formed in the head 502, with the cutout has an entrance 532 for receiving the coupling member 520 and a locking portion 534 in which the coupling member 520 can be directed into and captured, thereby coupling the coupling member 520 of one fastener 500 to another fastener 500. The locking portion 534 can be a tapered slot that terminates at an inner end with a spherical shaped opening and the entrance 532 includes a rounded side with an overhang that covers the coupling member 520 and prevents axial disengagement of the coupling member 520 from the head when the coupling member 520 enters the entrance 532. As shown in the figures, the entrance 532 can be in the form of cut-out formed in the side walls of the head 502. The entrance 532 can thus have an arcuate component and extends circumferentially within the head. As shown, the top wall of the head 502 is partially open as well to receive the neck.

To enter the locking portion 534, the coupling member 520 (ball or disk-shaped member) enters the entrance 532 is then moved sideways into the tapered locking portion 534 and is then directed inwardly until the ball or disk-shaped member (coupling members) enters the spherical shaped space. The spherical shape of the space and overhanging wall structure captures the coupling member 520 in the locking portion 534.

The coupling member 520 is moved to the center of the head and then in this locked position (retained position), one fastener 500 is coupled to another fastener 500 that is still attached to the rail 200. To remove the fastener 500 that is attached to the rail 200, the outer fastener 500 that is coupled to the fastener 500 attached to the rail 200 is pulled outwardly, thereby disengagement the barbs from the channel.

The fastener 500 which can be formed of plastic or other material, such as wood or metal.

The fastener 500 serves a dual purpose in that the fasteners 500 hold the substrate 20 in the rail 200 and they are also designed so that one fastener 500 can be used as a tool to remove another fastener 500 as described and illustrated herein. The fasteners 500 also have an additional use now in that they provide open cavities (cutout) to put the heads of nails if the user wanted to hang this on the wall without the string.

The assembly is assembled in the same manner described above in that the fasteners 500 are used to capture the substrate 20 in the rail 200. In other words, the fasteners 500 are fed into the holes 250 and pass through the holes/slits 21 formed in the substrate 20. The fasteners 500 are pushed into the holes 250 until the barbs 510 enter into the second shaft section 256 and fit snug therein. This snug fit effectively anchors the substrate 20 within the channel 220, thereby attaching the substrate 20 to the top rail 200. The process is repeated for each hole 250 formed in the top rail 200.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A vertical slot hanger assembly comprising:

a substrate having a top edge and a bottom edge and a plurality of holes or slits formed therein along each of the top edge and the bottom edge;

a top rail and a bottom rail, each of the top rail and the bottom rail including a recessed channel that extends in a longitudinal direction, each rail having a plurality of blind holes formed therein, each blind hole intersecting the recessed channel, wherein the top edge of the substrate is received within the recessed channel of the top rail and the bottom edge of the substrate is received within the recessed channel of the bottom rail;

an elongated hanging element that is disposed within the recessed channel between the top edge of the substrate and a top surface of the recessed channel; and a plurality of fasteners for reception in the plurality of blind holes, each fastener passing through one hole or slit of the substrate and being frictionally held and anchored within the respective blind hole, thereby securely coupling the substrate to the top rail and the bottom rail;

wherein the plurality of fasteners are separate and detached from one another and are configured to be independently inserted into the plurality of blind holes which are separate and spaced apart from one another.

2. The vertical slot hanger assembly of claim 1, wherein the recessed channel formed in the top rail is open at both ends of the top rail and the elongated hanging element exits the open ends of the top rail.

3. The vertical slot hanger assembly of claim 1, wherein the elongated hanging element comprises one of a cable, string, rope, and wire.

4. The vertical slot hanger assembly of claim 1, wherein the rail has a square cross-sectional shape.

5. The vertical slot hanger assembly of claim 1, wherein each blind hole has a countersunk landing formed around the blind hole against which a head of one respective fastener seats.

6. The vertical slot hanger assembly of claim 1, wherein the substrate comprises a canvas material.

7. The vertical slot hanger assembly of claim 1, wherein there are two holes or slits formed along each of the top edge and the bottom edge.

8. A vertical slot hanger assembly comprising:

a substrate having a top edge and a bottom edge and a plurality of holes or slits formed therein along each of the top edge and the bottom edge;

a top rail and a bottom rail, each of the top rail and the bottom rail including a recessed channel that extends in a longitudinal direction, each rail having a plurality of blind holes formed therein, each blind hole intersecting the recessed channel, wherein the top edge of the substrate is received within the recessed channel of the top rail and the bottom edge of the substrate is received within the recessed channel of the bottom rail;

an elongated hanging element that is disposed within the recessed channel between the top edge of the substrate and a top surface of the recessed channel; and a plurality of fasteners for reception in the plurality of blind holes, each fastener passing through one hole or slit of the substrate and being frictionally held and anchored within the respective blind hole, thereby securely coupling the substrate to the top rail and the bottom rail;

wherein each blind hole has a countersunk landing formed around the blind hole against which a head of one respective fastener seats;

wherein the blind hole has a first shaft section and a second shaft section that defines a closed end of the blind hole.

9. The vertical slot hanger assembly of claim 8, wherein the second shaft section has a diameter that is less than a diameter of the first shaft section.

10. The vertical slot hanger assembly of claim 9, wherein the fastener has a barbed section that seats within the second shaft section to frictionally hold the fastener within the blind hole.

11. A vertical slot hanger assembly comprising:

a substrate having a top edge and a plurality of holes or slits formed therein along the top edge;

a top rail that includes a first surface, an opposite second surface and a bottom surface that extends between the first surface and the second surface, the top rail including a recessed channel that extends in a longitudinal direction and is only open along the bottom surface of the top rail and is defined by first and second inner surfaces of the top rail, the top rail having a plurality of blind holes formed therein, each blind hole being open along the first surface and extending in a direction toward the second surface, intersecting the recessed channel, wherein the top edge of the substrate is received and fully contained within the recessed channel of the top rail and is between the first and second inner surface of the top rail, wherein the first surface is offset 90 degrees from the bottom surface; and a plurality of first fasteners for reception and anchoring in the plurality of blind holes, each fastener passing through one hole or slit of the substrate and being frictionally held and anchored within the respective blind hole, thereby securely coupling the substrate to the top rail.

12. The vertical slot hanger assembly of claim 11, wherein the substrate has a bottom edge and a plurality of holes or slits formed therein along the bottom edge; and further including:

a bottom rail including a recessed channel that extends in a longitudinal direction, the bottom rail having a plurality of blind holes formed therein, each blind hole intersecting the recessed channel, wherein the bottom edge of the substrate is received within the recessed channel of the bottom rail; and a plurality of fasteners passing through one hole or slit of the substrate and being frictionally held and anchored within the respective blind hole, thereby securely coupling the substrate to the bottom rail.

13. The vertical slot hanger assembly of claim 11, further including a flexible elongated hanging element that is disposed within the recessed channel between the top edge of the substrate and a top surface of the recessed channel.

14. A vertical slot hanger assembly comprising:

a substrate having a top edge and a bottom edge and a plurality of holes or slits formed therein along each of the top edge and the bottom edge;

a top rail and a bottom rail, each of the top rail and the bottom rail including a recessed channel that extends in a longitudinal direction, each rail having a plurality of blind holes formed therein, each blind hole intersecting the recessed channel, wherein the top edge of the substrate is received within the recessed channel of the top rail and the bottom edge of the substrate is received within the recessed channel of the bottom rail;

an elongated hanging element that is disposed within the recessed channel between the top edge of the substrate and a top surface of the recessed channel; and a plurality of fasteners for reception in the plurality of blind holes, each fastener passing through one hole or slit of the substrate and being frictionally held and anchored within the respective blind hole, thereby securely coupling the substrate to the top rail and the bottom rail;

wherein each fastener of the plurality of fasteners includes a head and an shaft that extends from the head and includes a barbed section and a coupling member at a distal end of the fastener, the head includes an entrance open along a side of the head, the entrance leading to a locking portion that is centrally located within the head and has a width that is less than a width of the entrance, the entrance being configured to permit one fastener to receive the coupling member of another fastener and permit reception of the coupling member within the locking portion to securely attach the other fastener to the one fastener such that rotation of the other fastener is imparted to rotation of the one fastener.

15. The vertical slot hanger assembly of claim 14, wherein the coupling member has a circular shape and a length of the shaft is located between the coupling member and the barbed section.

* * * * *